United States Patent [19]

Squires

[11] 3,955,427

[45] May 11, 1976

[54] STARTER MOTORS

[75] Inventor: Christopher Peter Squires, Birmingham, England

[73] Assignee: The Lucas Electrical Company Limited, Birmingham, England

[22] Filed: Oct. 3, 1974

[21] Appl. No.: 511,778

[30] Foreign Application Priority Data

Oct. 9, 1974 United Kingdom ..... 47068/74

[52] U.S. Cl. ..... 74/6 R; 74/7 A

[51] Int. Cl.[2] ..... F02N 2/00

[58] Field of Search ..... 74/6 R, 7 R, 7 A, 7 B

[56] References Cited

UNITED STATES PATENTS

| | | | |
|---|---|---|---|
| 1,888,717 | 11/1932 | Ford | 74/6 |
| 3,177,728 | 4/1965 | Farison | 74/7 A |
| 3,701,285 | 10/1972 | Toulier | 74/6 |
| 3,788,151 | 1/1974 | Campau | 74/7 A |
| 3,866,960 | 2/1975 | Chohan | 74/6 |

FOREIGN PATENTS OR APPLICATIONS

| | | | |
|---|---|---|---|
| 1,424,804 | 4/1964 | France | 74/7 R |
| 522,839 | 6/1940 | United Kingdom | 74/7 A |
| 923,883 | 1/1955 | Germany | 74/7 A |

*Primary Examiner*—Samuel Scott
*Assistant Examiner*—Randall Heald

[57] ABSTRACT

A starter motor for an internal combustion engine including a pinion gear wheel assembly movable between a rest position and an operative position. The pinion gear wheel assembly is movable by a solenoid the armature of the solenoid being coupled to the pinion gear wheel assembly by way of a lever pivoted on the starter motor casing. The lever is in the form of a pair of resilient elements. The first resilient element is weaker than the resilient means which urges the armature towards its rest position, so that should the pinion gear wheel assembly be held in its operative position when the electromagnet is de-energised then the armature can be returned to its rest position flexing the first element. The second element supports the first element during movement of the lever assembly to push the pinion gear wheel assembly to its operative position. The combined strength of the first and second elements is such that if the pinion gear wheel assembly is held against movement to its operative position then both elements can be flexed by movement of the armature to its operative position. However, the flexed elements together provide sufficient force to move the pinion gear wheel assembly rapidly to its operative position when the impediment to movement of the assembly is removed.

2 Claims, 4 Drawing Figures

STARTER MOTORS

This invention relates to starter motors, for internal combustion engines, of the kind including an electric motor, a shaft rotated by said electric motor, a pinion gear-wheel assembly rotatable with said shaft and mounted on said shaft for axial movement relative thereto between an operative position and a rest position, an electromagnet including an armature spaced from and movable parallel to said shaft, and a lever assembly supported intermediate its ends for pivotal movement about an axis at right angles to and between the axes of the shaft and electromagnet, the lever assembly connecting the armature and the pinion assembly so that the pinion assembly can be moved between said positions by said armature, the armature being resiliently urged to a rest position corresponding to the rest position of the pinion assembly and being movable by energisation of the electromagnet to an operative position corresponding to the operative position of the pinion assembly.

According to the invention in a starter motor of the kind specified said lever assembly includes a first resilient element which is weaker than said resilient means urging the armature to its rest position so that should the pinion gear wheel assembly be held in its operative position when the electromagnet is de-energised then the armature can be returned to its rest position flexing said element, and a second resilient element which supports said first resilient element during movement of the lever assembly to push the pinion gear-wheel assembly to its operative position, the strength of the first and second elements acting together being such that if the pinion gear-wheel assembly is held against movement to its operative position then both elements can be flexed by movement of the armature to its operative position, while providing sufficient force to move the pinion gear-wheel assembly to its operative position when the impediment to movement of the pinion gear-wheel assembly is removed.

Preferably the lever assembly is supported for said pivotal movement by a pair of abutments between which the lever assembly extends.

Figure 1:
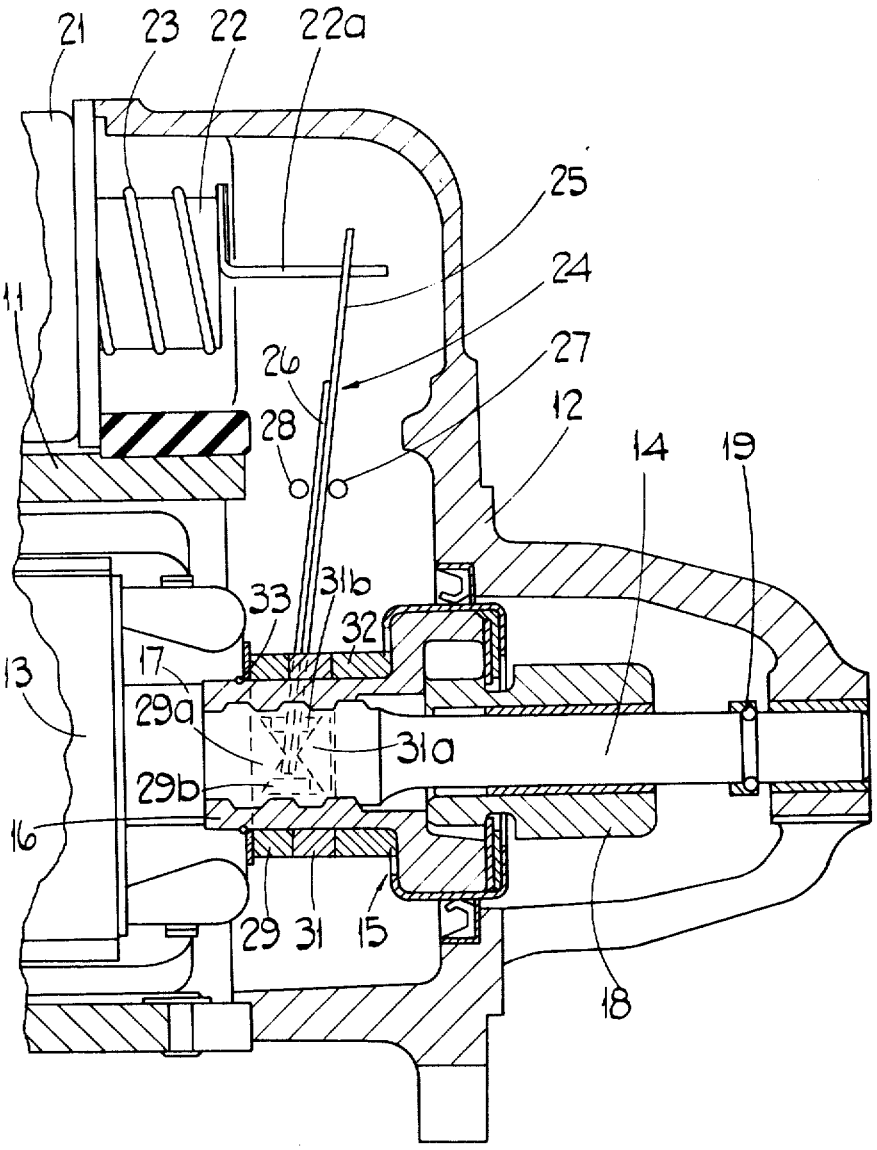
Figure 2:
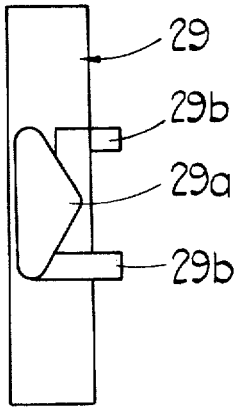
Figure 3:
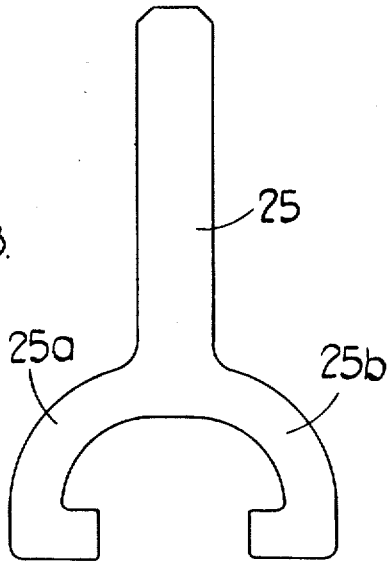
Figure 4:
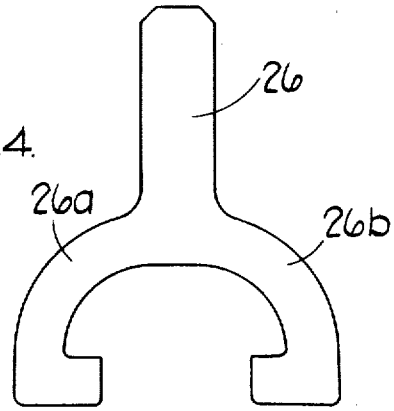

One example of the invention is illustrated in the accompanying drawings wherein, FIG. 1 is a cross-sectional representation of part of a starter motor for an internal combustion engine, FIG. 2 is a side elevational view of a component of the pinion gear-wheel assembly shown in FIG. 1, and FIGS. 3 and 4 are plungers respectively of parts of the lever assembly shown in FIG. 1.

Referring to the drawings, the starter motor includes a cylindrical steel casing 11 closed at one end by a cast end cup assembly 12. Within the cylindrical casing 12 is an electric motor the rotor 13 of which is supported by a shaft 14 journalled for rotation at one end in the end cup assembly 12, and at its other end in a second end cup assembly secured to the opposite end of the casing 11. The stator assembly of the electric motor is carried on the inner surface of the casing 11, the casing 11 itself constituting at least part of the magnetic yoke of the stator assembly. A pinion gear-wheel assembly 15 is carried by the shaft 14 between the rotor 13 and the adjacent shaft bearing. As in conventional starter motors the assembly 15 is capable of both limited rotational, and axial movement relative to the shaft 14, and is coupled to the shaft 14 by way of helical splines on the shaft 14 and the inner surface of a sleeve 16 of the assembly 15. The pinion assembly is thus movable axially relative to the shaft 14 between a rest position (as shown in FIG. 1) where the sleeve 16 abuts a collar 17 of the shaft, and an operative position wherein the free end of the pinion gear-wheel 18 of the assembly 15 abuts a stop member 19 carried by the shaft, and, in use, is in meshing engagement with the toothed wheel of an associated internal combustion engine. By virtue of the helical splined connection the axial movement of the pinion assembly 15 between its rest position and its operative position is accompanied by rotation of the pinion assembly relative to the shaft. However, at the limits of its movement, particularly at its operative position, the pinion assembly is rotated by the shaft 14 when the shaft 14 is driven by the electric motor.

In order to move the pinion assembly 15 between its limits positions there is provided a solenoid 21 including an electromagnet winding and an armature 22. The solenoid 22 is secured to the casing 11, and so is spaced from the shaft 14, and the solenoid 21 is so arranged that the armature 22 is moveable parallel to the shaft 14. A return spring 23 urges the armature 21 to a rest position from which the armature can be retracted into the casing of the solenoid against the action of the spring 23 by energisation of the electromagnet winding.

The armature 22 is coupled to the pinion assembly 15 by a lever assembly 24 supported intermediate its ends for pivotal movement relative to the casing. The lever assembly is mounted for pivotal movement about an axis at right angles to, and passing between the axes of the armature 22 and the shaft 14, and so the outermost, rest position of the armature 22 corresponds to a retracted, rest position of the pinion assembly 15.

The lever assembly 24 is defined by first and second spring steel elements 25, 26. The element 25 extends at one end through an aperture in an extension **22*a* of the armature 22, and is coupled, in a manner to be described, at its opposite end to the pinion assembly 15. The element 26 is shorter than the element 25, and lies in facial contact with the surface of the element 25 presented towards the motor and solenoid. The element 26 is coupled in the same manner as the element 25 to the pinion assembly 15, but is insufficiently long to reach the extension 22*a*. The lever assembly 24 is pivotally supported on the casing of the starter motor by means of a pair of parallel cylindrical pins 27, 28 which are secured to the end cap assembly 12, and which extend at right angles to the axes of the shaft 14 and the solenoid 21, and which lie in a plane parallel to and passing between the axes. The two elements of the lever assembly 24 pass between the pins 27, 28 and so the pins 27, 28** each define a fulcrum about which the lever assembly can pivot.

The connection of the elements 25, 26 to the pinion assembly 15 is as follows. At its end remote from the solenoid 21 each of the elements 25, 26 is bifurcated to define a pair of part-circular limbs indicated in FIGS. 3 and 4 by the suffixes *a* and *b*. The spacing of the limbs **25*a*, 25*b* and 26*a*, 26*b* is such that the limbs can pass on either side of the sleeve 16 of the pinion assembly 15, and at its free end each of the four limbs includes an inturned tag. Thus when the lever assembly is correctly positioned with respect to the pinion assembly the limbs 25*a*, 26*a* lie to one side of the sleeve 16, the limbs 25*b*, 26*b* lie to the opposite side of the sleeve 16, and the tags of the limbs extend inwardly towards the sleeve. Encircling the sleeve 16 and trapped in position at one end by an abutment collar 32 and at the other end by a circlip 33 are a pair of coupling rings 29, 31. The coupling rings 29, 31** are moulded in synthetic resin material, and each includes a pair of diametrically opposed radially outwardly extending lugs indicated in the drawing by the suffix *a*. The lugs of the rings 29, 31 are shaped such that they present apical edges to one another, and are so dimensioned that the gap between the apical edges of the lugs 29*a*, 31*a* on either side of the sleeve 16 are sufficiently wide to receive the tags of the limbs 25*a*, 26*a* and 25*b*, 26*b* respectively. In addition, each of the rings 29, 31 includes an integral stop member indicated by the suffix *b* and associated with a respective lug, such that the two stop members one each side of the pinion assembly define upper and lower abutments between which the tags of the limbs 25, 26 extend. Thus on each side of the pinion assembly 15 the rings 29, 31 together define a recess into which the tags of the appropriate limbs of the elements 25, 26 extend. The apical edges of the lugs 29*a*, 31*a* prevent movement of the lever assembly 24 in an axial direction relative to the pinion assembly, and the stop members 29*b*, 31*b* prevent lateral movement of the assembly 24 relative to the assembly 15. However, it will be appreciated that since the lever assembly is gripped between a pair of opposite apical edges then the lever assembly can pivot about these edges relative to the pinion assembly.

The operation of the starter motor is as follows. When the starter motor is inoperative the components thereof are in the position shown in FIG. 1. The armature 22 of the solenoid 21 is in its rest position, as is the pinion assembly. When it is desired to operate the starter motor the electromagnet winding of the solenoid 21 is first energised, so retracting the armature 22 against the action of the spring 23. The lever assembly 24 pivots about the pin 28 so pushing the pinion assembly 15 along the shaft 14 towards its operative position. By virtue of the helical splined connection between the pinion assembly and the shaft 14 the pinion assembly rotates relative to the shaft 14 as it moves axially from its rest position towards its operative position. Assuming that the pinion gear wheel 18 cleanly engages the toothed wheel of the internal combustion engine, and moves into full meshing engagement then the lever 24 acts as an inflexible lever, and as the pinion assembly reaches its operative position the armature 22 closes an associated electrical switch causing energisation of the electric motor, and consequent rotation of the shaft 14. As stated above, rotation of the shaft 14 rotates the pinion assembly 15, so that the gear wheel 18 drives the toothed wheel of the engine.

When it is desired to cease operation of the starter motor a manually operable switch is opened to de-energise the solenoid 21. Upon de-energisation of the solenoid 21 the spring 23 returns the armature 22 towards its rest position. However, until the armature 22 moves a predetermined distance towards its rest position the switch controlling energisation of the electric motor is not opened, and so the shaft 14 continues to be driven. While the shaft 14 is driven there is of course a tendency for the pinion gear wheel 18 to be retained in its operative position. In order that the starter motor can be readily returned to its inoperative status, the element 25 of the lever assembly 24 is so chosen that its strength is less than the strength of the spring 23, so that if there is a tendency for the pinion assembly to be held in its operative position then the lever 25 will be flexed permitting the armature 22 to return to its rest position, whereupon the electric motor will be de-energised, and the impediment to return movement of the pinion assembly will be removed. Thus the energy stored in the element 25 by flexure thereof is utilised in returning the pinion assembly back to its rest position whereupon the components achieve once again the positions shown in FIG. 1.

During operation of the starter motor should the pinion gear wheel 18 meet the toothed wheel of the engine in tooth-to-tooth engagement, then movement of the pinion assembly towards its operative position will be arrested prior to the armature 22 reaching the position where the switch controlling energisation of the motor is operated. During movement of the lever assembly 24 in this direction the element 26 is of course supporting the element 25 and so the strength of the lever assembly is greater than during movement of the lever assembly in the opposite direction. However, the electromagnet is sufficiently strong to cause flexure of the elements 25, and 26 and so the switch controlling energisation of the electric motor can be operated. Immediately the shaft 14 starts to turn the tooth-to-tooth condition will of course be alleviated, and the pinion gear wheel 18 will be free to move into meshing engagement with the toothed wheel of the engine. The pinion assembly will then be moved to its operative position rapidly by the lever assembly as the lever assembly restores to its straight condition. Since both elements of the lever assembly were flexed then the force which is exerted on the pinion assembly is sufficiently strong to move the pinion assembly extremely rapidly to its operative position and it will be appreciated that this situation is extremely desirable, since the shaft will be rotating relative to the toothed wheel of the engine and unless the pinion is moved rapidly into full engagement with the toothed wheel milling of the pinion against the toothed wheel can occur.

When the solenoid is fully operated, the pinion may still be able to move further into engagement (onto stop) by helix action such movement is taken up by flexure of the spring lever 25, 26.

In the arrangement described above there is a risk that the element 25 may be damaged by over travel of the armature 22 during return of armature 22 to its rest position. In order to minimise this risk, the assembly can be modified by the removal of the inturned tags of the limbs 26*a*, 26*b* of the element 26. This modification permits the lower end of element 26 to move relative to the pinion assembly during such over travel of the armature 22 so that the element 25 can flex along its whole length to accommodate the over travel. It will be recognised that if the element 26 cannot so move then flexure of the element 25 to accommodate the over travel is restricted to flexure of that portion of the element 25 adjacent the armature 22.

I claim:

1. A starter motor, for an internal combustion engine, including an electric motor, a shaft rotated by said motor, a pinion gear-wheel assembly rotatable with said shaft, and movable axially on said shaft between an operative position and a rest position, an electro-magnet including an armature spaced from, and movable parallel to the said shaft and a lever assembly supported intermediate its ends for pivotal movement about an axis which lies at right angles to and which passes between, the axes of the shaft and the electromagnet, the lever assembly connecting the armature and the pinion assembly so that the pinion assembly can be moved between said rest and operative positions by said armature, resilient means urging the armature to a rest position, and said lever assembly including a first resilient element having one end engaging the armature, and its other end engaging the pinion assembly, said first resilient element being weaker than said resilient means, whereby in the event that the pinion gear-wheel assembly is held in its operative position, then when the electromagnet is de-energised the armature can be returned to its rest position, by said resilient means as permitted by flexure of said first resilient element, and said lever assembly further including a second resilient element, said second resilient element being so arranged with respect to said first resilient element that said second resilient element supports said first resilient element only during movement of the lever assembly to push the pinion gear-wheel assembly to its operative position, the combined strength of the first and second elements being insufficient to prevent movement of said armature under the action of the electro-magnet should the pinion gear-wheel assembly be held against movement to its operative position, whereby the first and second lever elements will be flexed by the movement of the armature and will thus provide sufficient force to move the pinion gear-wheel assembly to its operative position when the impediment to movement of the pinion gear-wheel assembly is removed.

2. A starter motor as claimed in claim 1 wherein said lever assembly is supported for said pivotal movement by a pair of abutments between which the lever assembly extends.

* * * * *

UNITED STATES PATENT AND TRADEMARK OFFICE

CERTIFICATE OF CORRECTION

PATENT NO. : 3,955,427

DATED : May 11, 1976

INVENTOR(S) : Christopher Peter Squires

It is certified that error appears in the above-identified patent and that said Letters Patent are hereby corrected as shown below:

On the Title Pate Item [30] should read
Foreign Application Priority Data

October 9, 1973 United Kingdom 47068/74

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*